United States Patent [19]

Jenq-Shyong

[11] Patent Number: 4,572,037

[45] Date of Patent: Feb. 25, 1986

[54] MONKEY WRENCH

[76] Inventor: Ke Jenq-Shyong, No. 397, Sec. 2 Tan Hsing Rd., Tan Yiang Village, Tan-Tzu Hsiang, Taichung Hsien, Taiwan

[21] Appl. No.: 590,857

[22] Filed: Mar. 19, 1984

[51] Int. Cl.[4] ..... B25B 13/12

[52] U.S. Cl. ..... 81/126

[58] Field of Search ..... 81/126, 132, 133

[56] References Cited

U.S. PATENT DOCUMENTS

| | | | |
|---|---|---|---|
| 1,664,932 | 4/1928 | Juricinec | 81/126 |
| 2,536,463 | 1/1951 | Ratliff | 81/126 |
| 2,636,412 | 4/1953 | Houdesheldt | 81/126 |
| 2,703,503 | 3/1955 | Hairston | 81/126 |
| 3,988,952 | 11/1976 | Dirks | 81/126 |

*Primary Examiner*—James G. Smith

[57] ABSTRACT

An improved monkey wrench comprising a handle having two prongs each having a space through hole, a main body rotatably disposed between the prongs of the handle, a spring loaded jaw mounted at the main body in the way such that it may be slightly moved towards or away from the main body, a movable jaw movably mounted into the main body, a push member slidably mounted on the top of said main body and fixedly attached to the movable jaw, and an actuating member mounted at the center of the main body and fastened to the handle.

2 Claims, 5 Drawing Figures

MONKEY WRENCH

BACKGROUND OF THE INVENTION

Although various kinds of monkey wrenches have been known for a long time, none of them can lead to satisfactory results. With reference to FIG. 5, there is shown a perspective view of a well-known prior art monkey wrench. As shown, the prior art monkey wrench comprises a handle (1) having a stationary jaw (400). A frame (200) is fixedly attached to the handle (1) by a rivet (280) and provided with a nut (800). The nut (800) is engaged with threaded portion (910) of a movable jaw (900). As a result, the movable jaw (900) may be controlled to move towards or away from the stationary jaw (400) by turning the nut (800) thereby enabling the distance (700) between the two jaws (900) and (700) to be adjusted.

However, it is inconvenient to adjust the distance between the two jaws and impossible to grip firmly the pipe or the like.

Accordingly, the inventor of this invention has contrived to design an improved monkey wrench so as to obviate and mitigate the above-mentioned drawbacks.

SUMMARY

It is a primary object of the present invention to provide an improved monkey wrench which is designed to obviate the above-mentioned drawbacks of the prior art monkey wrench.

It is still another object of the present invention to provide an improved monkey wrench which is easy to adjust.

It is still another object of the present invention to provide an improved monkey wrench which may grip a pipe or the like firmly.

It is still another object of the present invention to provide an improved monkey wrench which is reliable on gripping a pipe or the like.

It is a further object of the present invention to provide an improved monkey wrench which is economic to produce.

It is still a further object of the present invention to provide an improved monkey wrench which is simple in structure.

Other objects and merits and a fuller understanding of the present invention will be obtained by those having ordinary skill in the art when the following detailed description of the best mode contemplated for practicing the invention has been read in conjunction with the accompanying drawings wherein like numerals refer to like or similar parts and in which:

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
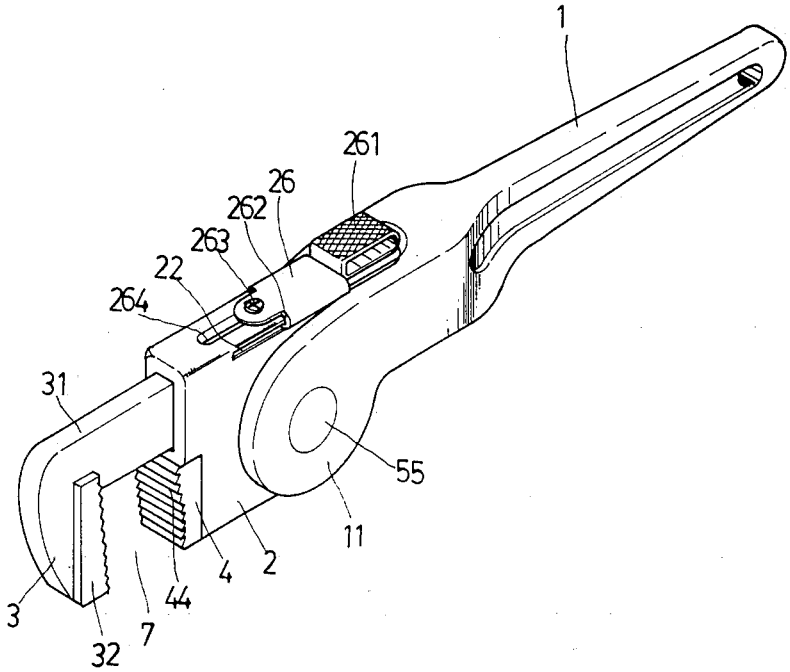
FIG. 1 is a perspective view of an improved monkey wrench according to a preferred embodiment of the present invention.
Figure 2:
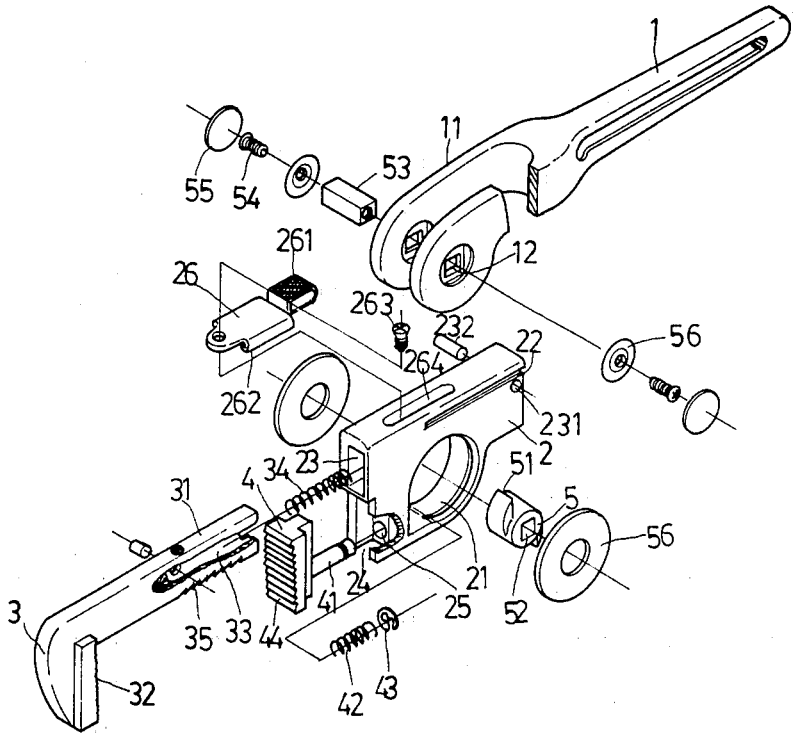
FIG. 2 is a fragmentary perspective view of the improved monkey wrench.

Referring now to the drawings and in particular to FIGS. 1 and 2, the improved monkey wrench according to the present invention comprises a handle (1) which is provided with two prongs (11) each having a square through hole (12). Between the two prongs (11) is disposed a main body (2) which comes with a hole (21) in the front, a slot (22) at both sides, a rectangular hole (23) communicating with the hole (21), a slot (264) connected with the hole (21) and a recess (24) having a hole (25) passing on the hole (21). A pin hole (231) is formed below the slots (22) on the main body (2), in which is inserted a pin (232).

A jaw (4) having a pin (41) at one end and a plurality of teeth at the other end is embedded on the recess (24), with the pin (41) inserted into the hole (21) of the recess (24). The pin (41) is encased in a spring (42) and then engaged with a retainer ring (43) at its free end, thereby causing the jaw (4) to be spring loaded.

The rectangular hole (23) is served to receive a movable jaw (3) which has a plurality of teeth (32) and an arm (31) provided with a recess (33) on which there is a spring (34). The spring is confined by a pin (36) and the pin (232) inserted into the main body (2). The lower part of the arm (31) is provided with serrated edge (35) having a plurality of teeth.

An actuating member (5) having a square hole (52) at its center and two symmetric teeth (51) extending from its circumference is positioned at the center of the hole (21) of the main body (2) by inserting a square shaft (52) through the square holes (12) of the prongs (11) and the square hole (52) of the acutating member (5). The square shaft (52) is fixed on the prongs (11) by engaging with a washer (56) and a screw (54) at both sides. Then, a circular plate (56) is fastened to each side of the prongs (11) for aesthetic purpose.

A push member (26) is positioned on the top of the main body (2) with its two feet inserted into the slots (22) of the main body, so that the push member (26) may move along the slots (22). The push member (26) is connected with the arm (31) of the movable jaw (3) by a screw (263) such that the movable jaw (3) will move together with the push member (26) along the rectangular hole (23).

Figure 3:
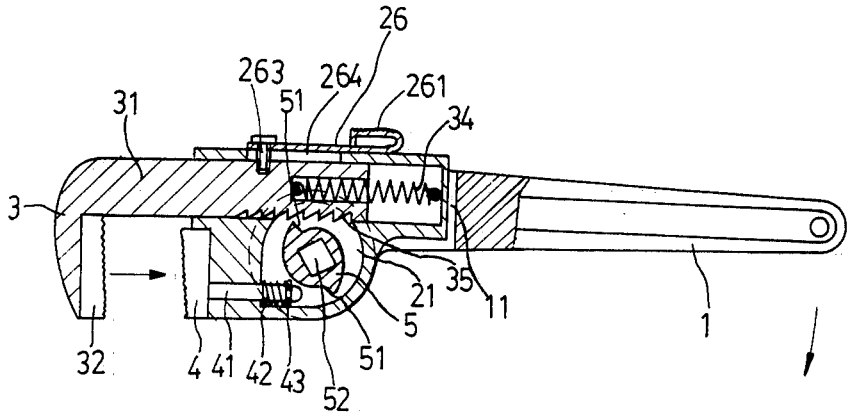
FIG. 3 is a sectional view of the improved monkey wrench.
Figure 4:
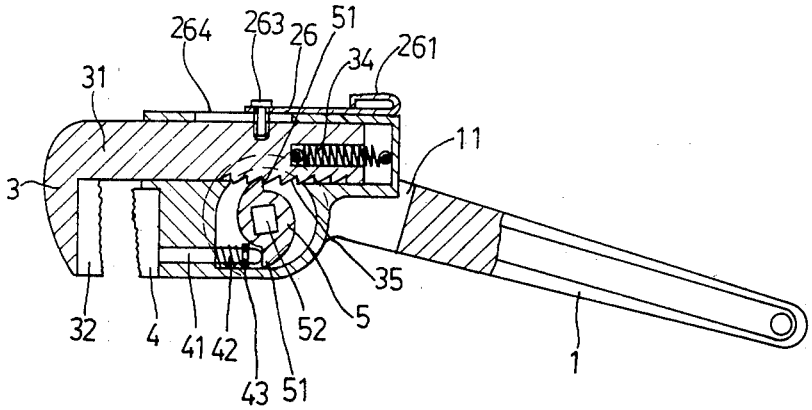
FIG. 4 is similar to FIG. 3, showing how the distance between the jaws of the improved monkey wrench is decreased when the handle is pressed down.
Figure 5:
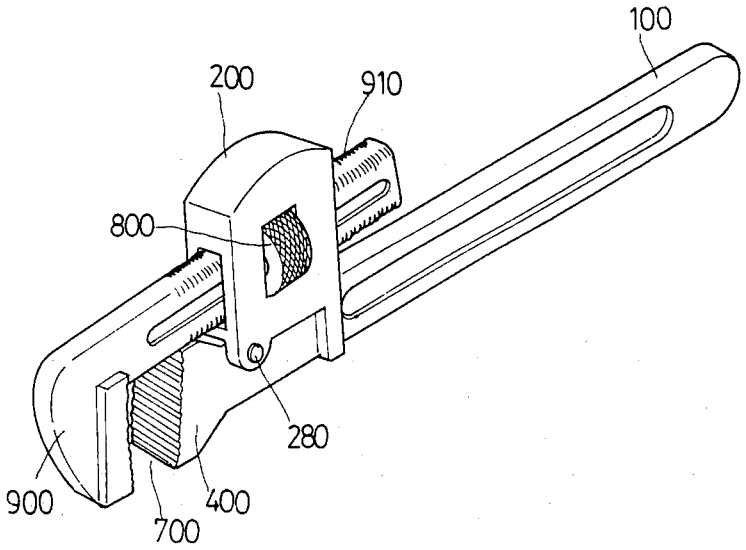
FIG. 5 is a perspective view illustrating a prior art monkey wrench.

The mechanism of the improved monkey wrench may be clearly seen in FIGS. 3 and 4.

Turning to FIG. 3, it is shown the normal state of the improved monkey wrench. As illustrated, both teeth (51) of the actuating member (5) are separated from the serrated edge (35) of the movable jaw (3) and the pin (41) of the spring loaded jaw (4). As a consequence, it is possible to force the push member (24) to move the movable jaw (3) towards or away from the jaw (4) thereby adjusting the distance between the two jaws (3) and (4).

When the handle (1) is turned in clockwise direction with respect to FIG. 4, the square shaft (53) will rotate in unison with the handle (1). The square shaft (53) in turn rotates the actuating member (5), causing the upper tooth (51) of the actuating member (5) to engage with the serrated edge (35) so as to pull backward the movable jaw (3) until the lower tooth (51) of the actuating member (5) is in contact with the pin (42) of the spring loaded jaw (4). As a result, the distance between the two jaws (3) and (4) is decreased and so the pipe (not shown) or the like can be gripped firmly.

Further, when the handle (1) is rotated in the direction indicated by arrow at the right side of FIG. 3, the torque exerted on the handle (1) will be first transmitted to the actuating member (5) and then to the spring loaded jaw (4) via the pin (42) and the movable jaw (3) via the teeth of the serrated edge (35), thereby increasing the gripping force on the pipe (not shown).

Although the present invention has been described with a certain degree of particularity, it is understood that the present disclosure has been made by way of example only and that numerous changes in the detail of parts and the combination and arrangement of parts may be resorted to without departing from the spirit and scope of the invention as hereinafter claimed.

I claim:

1. An improved monkey wrench comprising:

a handle having two prongs each having a square through hole;

a main body rotatably disposed between said prongs of said handle;

a spring loaded jaw mounted to said main body in the way such that said spring loaded jaw may be slightly moved towards or away from said main body;

a movable jaw movably mounted into said main body, said movable jaw having a serrated edge at its lower edge;

a push member slidably mounted on the top of said main body and fixedly attached to said movable jaw in such a way that said movable jaw may be moved in unison with said push member with respect to said main body; and an actuating member mounted at the center of said main body and fastened to said handle, said actuating member having two teeth which are designed so that when said handle is pressed one said tooth will force said serrated edge to go backward but will force a pin of said spring loaded jaw to go forward.

2. An improved monkey wrench as claimed in claim 1, wherein said movable jaw is spring loaded.

* * * * *